US005984979A

United States Patent [19]

Bella et al.

[11] Patent Number: 5,984,979

[45] **Date of Patent: *Nov. 16, 1999**

[54] METHOD OF REACTIVE DYEING OF TEXTILE MATERIALS USING CARBOXYLATE SALT

[75] Inventors: Otto Bella, Tryon, N.C.; Calvin M. Wicker, Jr., Spartanburg; Robert B. Login, Simpsonville, both of S.C.

[73] Assignee: Sybron Chemicals Inc., Birmingham, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,814

[22] Filed: Oct. 8, 1997

[51] Int. Cl.[6] ..... D06P 3/66

[52] U.S. Cl. ..... 8/543; 8/549; 8/594; 8/918

[58] Field of Search ..... 8/543–9, 918, 8/594

[56] References Cited

U.S. PATENT DOCUMENTS

| | | |
|---|---|---|
| 3,574,515 | 4/1971 | Huppertz et al. . |
| 3,630,662 | 12/1971 | Brody . |
| 3,980,426 | 9/1976 | Feess et al. . |
| 4,149,850 | 4/1979 | Schlafer et al. . |
| 4,308,025 | 12/1981 | Hussamy . |
| 4,588,411 | 5/1986 | Scheibli et al. . |
| 5,085,668 | 2/1992 | Pelster et al. . |
| 5,207,800 | 5/1993 | Moore . |
| 5,330,541 | 7/1994 | Hall et al. . |
| 5,378,242 | 1/1995 | Christie et al. . |
| 5,378,245 | 1/1995 | Balland . |
| 5,382,262 | 1/1995 | Moore . |
| 5,403,360 | 4/1995 | Süterlin et al. . |
| 5,435,930 | 7/1995 | Chan et al. . |
| 5,443,630 | 8/1995 | von der Eltz et al. . |
| 5,489,313 | 2/1996 | Hall et al. . |
| 5,575,821 | 11/1996 | Schrell et al. . |
| 5,603,736 | 2/1997 | Moore . |

FOREIGN PATENT DOCUMENTS

| | | |
|---|---|---|
| 9-13282 | 1/1997 | Japan . |

OTHER PUBLICATIONS

Rucker et al, "Reduction of Salt Requirements in Dyeing Cotton with Fiber Reactive Dyes," *Book of Papers*, 1997 International Conference & Exhibition, AATCC, Sep. 28–Oct 11, 1997.

Cook, Dr. Fred L., "Salt Requirements Put Pressure On Wet Processing Plants", *Textile World*, pp. 83–86 (Aug. 1994).

Moore, S.B., "Chemically Preciptable Alkaline Earth Salts As Direct Dyeing Electrolytes", *American Dyestuff Reporter*, pp. 76–78 (Sep. 1993).

Rucker, James W., et al. "Reduction of Salt Requirements in Dyeing Cotton with Fiber Reactive Dyes", *Textile Chemist and Colorist*, pp. vol. 29., p. 8 (Aug. 1997).

Herlant, Michael, "Low Salt Dyeing of Cellulosics", *American Dyestuff Reporter*, pp. 19–25 (Apr. 1993).

Anderson, Clyde B., "Dyeing Reactive Dyes Using Less Salt", *American Dyestuff Reporter*, pp. 103–104 (Sep. 1994).

Hildebrand, Dr. Dietrich, et al., "Modern Process Technology For Reactive Dyes: Linear Metering of Alkali And Reduction Of Salt Additions In The Dyeing Of Cellulosic Fibres With Levafix E/EA/EN Dyestuffs", *Melliand English*, pp. E447–E448 (Dec. 1988); (Translation of Melliand Textilberichte 69 (1988), p. 895).

Evzen Polasek, et al., "Exhaust Application Of Fibre Reactive Dyes With Reduced Salt Amount", (1987); (Translation of Melliand Textilberichte 68 (1987), pp. 125–131).

*Primary Examiner*—Margaret Einsmann
*Attorney, Agent, or Firm*—Akin, Gump, Strauss, Hauer & Feld, L.L.P.

[57] ABSTRACT

An immersion method of dyeing textile material includes the steps of (a) providing a textile material comprising at least one of cotton and regenerated cellulosic fibers; (b) providing an aqueous dyebath in a weight ratio of dyebath:textile material of 10:1 to 20:1, the dyebath comprising a reactive dye and a carboxylate salt for salting out the dye onto the textile material, the carboxylate salt having a carboxylate anionic component and a monovalent cationic component, wherein the carboxylate salt is present in an amount effective for salting out the dye onto the textile material; (c) immersing the textile material in the aqueous dyebath under conditions sufficient to salt the dye onto the textile material; (d) adding to the dyebath an alkaline material to promote a reaction to form a chemical bond between the dye and the textile material; and (e) subjecting the dyebath containing the textile material and the alkaline material to conditions sufficient to form a chemical bond between the dye and the textile material.

25 Claims, No Drawings

METHOD OF REACTIVE DYEING OF TEXTILE MATERIALS USING CARBOXYLATE SALT

BACKGROUND OF THE INVENTION

The invention relates to the use of carboxylate salt compositions in the dyeing of textile materials. Large quantities of salt are required in the process of dyeing cellulosics in order to exhaust the dyes onto the textile materials. Salt requirements vary depending upon the type of dye and dye procedure, with direct dyes requiring substantially less salt than reactive dyes. Conventionally, both direct dyes and reactive dyes are used in an aqueous bath in the presence of a neutral salt, which is typically sodium sulfate (Glauber's salt) or sodium chloride. During this stage, the dye is absorbed by the fabric as the result of a "salting out" effect from the added salt. For reactive dyes, the salting out step is followed by a reaction step in which alkaline material is added to promote a covalent bond between the dye and the fabric.

In a conventional dyeing operation, the required amount of salt increases as the depth of shade moves from the pastel/light to the dark range. Direct dyes ordinarily require about 2.5 to about 7.5 grams (g) per liter (L) for light shades, about 7.5 to about 12.5 g/L for medium shades, and about 12.5 to about 20 g/L for dark shades. Fiber reactive dyes require amounts 5 to 10 times higher than direct dyes, with ranges of about 30 to about 60 g/L for light shades, about 60 to about 80 g/L for medium shades, and about 80 to about 100 g/L for dark shades. The large quantities of salt in the dyeing process result in large quantities of salt in dye house wastewater that usually ranges from tpproximately 2,000 ppm to approximately 3,000 ppm. The large quantities of salt used in the dyeing of cellulose textile materials combined with a growth of cotton in the U.S. apparel market has resulted in increasing environmental concerns. The salt output from the textile industry can produce toxic effects on freshwater organisms due to increased salinity of the water. The environmental problems associated with large quantities of chloride in the water have resulted in regulatory limits on textile plant wastewater which start at 250 ppm of chloride. Although sulfate in the water is not currently regulated per se, increased salinity of wastewater due to the use of large amounts of sodium sulfate in the dyeing process is a significant concern. Additionally, wastewater containing large amounts of dissolved salts has been identified as contributing to decreased efficiencies of wastewater treatment plants as the result of the high amount of dissolved solids.

Various strategies have been employed or suggested for reducing the salt content in textile mill effluent that is attributable to the dyeing process. These include the development of new dyes which require less salt, the recycling of dyebaths, and the derivatization of cotton to make it cationic. Although the development of new dyes which require less salt has some potential for alleviating the salt requirementsjn the dyeing process, this is a long-term project and only a partial solution to the problem because salt requirements will be reduced but will still remain substantial. Additionally, revamping entire dye lines will take considerable time in research and development and in commercial translation. Derivatization of cotton so that less salt is required in the dyeing process has resulted in non-uniformity in the dyed product. Problems associated with dyebath reuse include the cost and the risk of a dirty dyeing procedure which adversely affects the dyeing of the fabric and results in dirty equipment, the eventual generation of chlorine or nonbiodegradable salt in the wastewater, and excessive waste.

In U.S. Pat. No. 5,207,800 (hereinafter "the '800 patent"), the use of alkaline earth metal organic salts for replacing sodium salts in dyeing cotton fabrics is disclosed. In particular, the '800 patent discloses the use of magnesium salts of organic acids. The '800 patent does not disclose or suggest the use of organic acid salts wherein the cation is something other than a bivalent alkaline earth metal, such as the monovalent alkali metals of sodium or potassium. The '800 patent discusses the importance of using alkaline earth metals salts, which have a lower solubility in water than sodium salts, so that the alkaline earth metals can be removed by precipitation during treatment of wastewater from the dyeing process. The '800 patent described the results as excellent with direct dyes and problematic with reactive dyes.

BRIEF SUMMARY OF THE INVENTION

The present invention allows for more environmentally sound processing of textile materials in that it teaches the use of biodegradable organic salts as a replacement for mineral salts in the dyeing process. The severity of the environmental concerns associated with the continued use of mineral salts establish that there is a significant and long felt need for the methods and compositions of this invention.

The invention relates to an aqueous dyebath for dyeing textile material comprising a dye and a carboxylate salt having a carboxylate anionic component and a monovalent cationic component, wherein the carboxylate salt is present in an amount effective for salting out the dye onto the textile material.

The invention also relates to a method of dyeing textile material comprising the steps of (a) providing a textile material, (b) providing an aqueous dyebath containing a dye and a carboxylate salt having a carboxylate anionic component and a monovalent cationic component, wherein the carboxylate salt is present in an amount effective for salting out the dye onto the textile material, and (c) contacting the textile material with the aqueous dyebath under conditions sufficient to the salt the dye onto the textile material.

The invention also relates to an aqueous dyebath for dyeing textile material comprising a dye and a salt, the salt having an anionic component and a cationic component, wherein the salt is present in an amount effective for salting out the dye onto the textile material, and wherein the anionic component is comprised of at least about 30% of at least one carboxylate anion, on a molar basis, and the cationic component is comprised of at least about 30% of at least one monovalent cation, on a molar basis.

The invention also relates to a method of dyeing textile material comprising the steps of (a) providing a textile material, (b) providing an aqueous dyebath containing a dye and a salt, the salt having a carboxylate anionic component and a monovalent cationic component, wherein the salt is present in an amount effective for salting out the dye onto the textile material, and wherein the anionic component is comprised of at least about 30% of at least one carboxylate anion, on a molar basis, and the cationic component is comprised of at least about 30% of at least one monovalent cation, on a molar basis, (c) contacting the textile material with the aqueous dyebath under conditions sufficient to salt the dye onto the textile material.

The invention also relates to a salt composition for use as an additive to dyebaths comprising an aqueous solution of about 30% to about 65% potassium acetate and at least one of a corrosion inhibitor and a biocide.

DETAILED DESCRIPTION OF THE INVENTION

The present invention relates to a process of salting out dyes onto textile material using carboxylate salts, with a carboxylate anionic component and a monovalent cationic component, in lieu of the conventional salts of sodium chloride (NaCl) and sodium sulfate ($Na_2SO_4$). Carboxylate salt compositions containing a biocide or an anticorrosive agent for use in the process of dyeing cellulosic textile material are also within the scope of the invention.

The compositions and methods of this invention have many advantages in the dyeing process. These include the environmental benefits of producing wastewater from textile plants which is biodegradable, thereby ameliorating the problems of wastewater with high salinity and wastewater with a high solids content. The compositions and methods of this invention also result in a reduction in corrosion of dye processing equipment, thereby resulting in reduced replacement costs for the equipment and allowing for the use of more inexpensive materials in the construction of the equipment.

"Textile material", as used herein, means fabric, yarns, fibers or filaments.

Although any textile material which is susceptible to dyeing with reactive dyes or direct dyes may be dyed using the methods and compositions of the present invention, the preferred textile materials are cellulosic materials, such as cotton, polyester-cotton blends, and regenerated cellulosic fibers such as rayon and Tencel®. Particularly preferred textile materials are those containing cotton in any amount. Thus, the preferred textile materials are cotton fabrics or yarns containing about 5 wt % to about 100 wt % cotton, including polyester-cotton blends preferably containing about 50% to about 80% cotton.

As used herein, the terms "percent", "%," "weight percent" and "wt %" all mean the percentage by weight of the indicated component or ingredient within the product or composition in which it is present, without dilution, unless otherwise indicated by the context in which the term is used.

Any dyes suitable for use as a reactive dye or as a direct dye may be used in accordance with the invention. A great many reactive dyes and direct dyes are known for dyeing fabrics, particularly cellulosic textile material, and they include virtually any color in the spectrum. They are readily available from a number of commercial sources.

One aspect of the present invention relates to an aqueous dyebath for dyeing textile material comprising a dye and a carboxylate salt, wherein the carboxylate salt has a carboxylate anionic component and a monovalent cationic component, and wherein the carboxylate salt is present in an amount effective for salting out the dye on to the textile material.

Another aspect of the present invention relates to a method for dyeing textile material comprising the steps of: (a) providing a textile material; (b) providing an aqueous dyebath comprising a dye and a carboxylate salt having a carboxylate anionic component and a monovalent cationic component, wherein the carboxylate salt is present in an amount effective for salting out the dye onto the textile material; and (c) contacting the textile material with the aqueous dyebath under conditions sufficient to salt the dye onto the textile material.

The carboxylate anion of the carboxylate salt is any carboxylate anion, or any combination of carboxylate anions, including but not limited to acetate, propionate, formate, citrate, maleate, and tartarate. The monovalent cation of the carboxylate salt can be any monovalent cation or any combination of monovalent cations including, but not limited to the alkali metals of sodium, potassium, and lithium, preferably sodium and potassium, and more preferably potassium. Other monovalent cations that may be used are organic cations, including, but not limited to, quaternary ammonium molecules of the formula $NR_4^+$, wherein R is a $C_1$–$C_6$ alkyl or alkenyl, which is a branched, straight chain or cyclic substituent. The organic cation must be soluble in water.

For direct dyes, the concentration of the carboxylate salt in the dyebath will typically be about 0.01 moles/liter to about 0.3 moles/liter and preferably about 0.015 moles/liter to about 0.24 moles/liter. For reactive dyes, the concentration of the salt in the dyebath will typically be about 0.04 moles/liter to about 0.7 moles/liter and preferably about 0.058 moles/liter to about 0.58 moles/liter. The carboxylate salt will typically be made up in concentrated solutions which are diluted into the dyebath, although the carboxylate salt may be added as solids directly into the dyebath. The salt may be produced in advance before being added to the dyebath by combining the carboxylic acid (the anionic component) and the base (the cationic component); alternatively, these components may be added separately to the dyebath to function in situ as the salt.

It is also contemplated as part of this invention that the carboxylate salts of this invention may be used in combination with other salts in the dyeing process. For example, in some situations it is desirable to combine the use of a carboxylate salt with $Na_2SO_4$ or NaCl to reduce the cost of the salt requirements or to reduce the biological oxygen demand (BOD) of the effluent from the dyebath that may occur with the use of carboxylale salts. Therefore, the invention relates to an aqueous dyebath for dyeing textile material comprising a dye and salt having an anionic component and a cationic component, wherein the salt is present in an amount effective for salting out the dye onto the textile material, and wherein the anionic component is comprised of at least about 30% of at least one carboxylate anion, on a molar basis, and the cationic component is comprised of at least about 30% of at least one monovalent cation, on a molar basis. Preferably, the anionic component is comprised of at least about 60% of at least one carboxylate anion, on a molar basis, and the cationic component is comprised of at least about 60% of at least one monovalent cation, on a molar basis. More preferably, the anionic component is comprised of at least about 85% of at least one carboxylate anion, on a molar basis, and the cationic component is comprised of at least about 85% of at least one monovalent cation, on a molar basis. It is estimated that about 88% of the NaCl salt will need to be replaced in the dyebath to drop the level of chloride delivered to the effluent to the required 250 ppm at a typical manufacturing facility.

Preferred carboxylate salt compositions for use in the present invention are potassium acetate and potassium citrate, with potassium acetate being more preferred for economic reasons. Typically, a dyebath for use with reactive dyes will contain about 5.7 to about 68.4 g/L of potassium acetate, and more preferably about 35 to about 62 g/L potassium acetate. Typically, a dyebath for use with direct dyes will contain about 1.4 to about 11.4 g/L of potassium acetate.

It is also contemplated as part of this invention that small amounts of $K_2SO_4$ may be added to the dyebath in which a carboxylate salt is the predominant salting out agent to improve yield. As demonstrated in Example 6, small amounts of $K_2SO_4$ in a dyebath in which potassium acetate was the predominant salting out agent resulted in an improvement in the dye yield. Typically, about 0.5 to about 2.0 g/L of $K_2SO_4$, and preferably about 1.0 g/L of $K_2SO_4$ may be used in the dyebath in conjunction with the carboxylate salt.

The textile material can be contacted with the aqueous dyebath of the present invention by various methods well known to those skilled in the art, such as by spraying, foam application, padding or immersion, for example. More particularly, applications methods known to those skilled in the art are typically characterized as an all-in method, continuous dyeing, cold pad-batch dyeing, cold exhaust dyeing, warm or hot exhaust dyeing and migration exhaust technique for less than 0.5% depth of shade, for example. These techniques are generally described in the *Kirk-Othmer Encyclopedia of Chernistry*, 3rd Edition, 8:693–694 (1989). Variations of reaction conditions may be undertaken without undue experimentation by those skilled in the art using available equipment and typical processing parameters. The preferred application is by immersion using the all-in method.

It is also contemplated as part of this invention that the carboxylate salts of this invention optionally may be used in conjunction with at least one corrosion inhibitor to prevent even minor corrosion of the equipment utilized in the dye process, if that should prove beneficial. Carboxylate salts, and potassium acetate in particular, are much less corrosive on either soft metal or 316 stainless steel, which is typically used in dyeing equipment, than either sodium chloride or sodium sulfate. Noncorrosive substitutes for conventional salts in the dyeing process offer two primary advantages: (1) expensive repairs to equipment would be much less frequent, thus lessening the cost of producing fabric; and (2) less expensive metals could be used in the design and building of new equipment. The use of corrosion inhibitors in conjunction with the use of carboxylate salts would further enhance this advantageous characteristic associated with the use of carboxylate salts. The corrosion inhibitor may be part of the carboxylate salt formulation or they may be added separately to the dyebath. Corrosion inhibitors which may be used in accordance with this invention include but are not limited to barium sulfate, hydroxyethylidine diphosphonic acid, sodium gluconate, and a 2:1 mixture, by weight, of sodium nitrite and potassium phosphate, wherein the mixture of sodium nitrite and potassium phosphate is preferred. The corrosion inhibitors, when present, may be used at a concentration in the stock carboxylate salt solution that would generate a concentration of corrosion inhibitor in the dyebath of about 0.01% to about 1.0%.

It is also contemplated as part of this invention that the carboxylate salt of the invention optionally may and preferably will be used in conjunction with at least one biocide to inhibit degradation of the organic component of the salts. The biocide may used to prevent premature degradation of a carboxylate salt stock solution or formulation. Biocides useful in this invention include but are not limited to bactericides and fungicides. Bactericides which may be used in accordance with this invention include, but are not limited to, benzyl trimethyl ammonium chloride, benzyl triethyl ammonium chloride, glutaraldehyde, 2-acetoxy-2,4-dimethyl-m-dioxane, N-alkyl-($C_{12}$, $C_{14}$, $C_{16}$) dimethyl benzyl ammonium chloride, wherein the first two are preferred. The bactericides will typically be used at a concentration of about 0.01% to about 1.0% in the carboxylate salt stock solution or formulation.

For addition of carboxylate salts to the dyebath, a relatively concentrated aqueous solution is preferred so that the carboxylate salt can be added to the dyebath without significantly diluting the dyebath. A preferred carboxylate salt solution is a potassium acetate solution of about 30% to about 65% potassium acetate, and more preferably about 50% to about 57% potassium acetate.

The potassium acetate solution may optionally be formulated with a biocide, as discussed herein. The potassium acetate solution may also optionally be formulated with a corrosion inhibitor as discussed herein.

Because the $C_1$–$C_4$ carboxylate anions of the present invention are organic, they easily degrade to yield a carbonate or bicarbonate, or a mixture thereof. This degradative step is important in that it offers two significant benefits to the effluent system. The first benefit is that carbonate or bicarbonate provide a buffering effect to the effluent holding ponds that is not available with the conventional salts. This will offer the biological system protection from pH fluctuations that may harm the degradative bacteria in the effluent system. A second benefit is that under very slightly acidic conditions that most effluent treatment systems see periodically, the carbonate will further degrade to carbon dioxide and water, completely disappearing from the system. The cations are left to form harmless salts with other anions in the systems, such as anionic dye residues, yarn finish components, and oxidation products of sizes and oils used in textile processing and will help the disperse and solubilize these components. The conventional salts remain in their original forms throughout the dye cycle and eventually contribute to environmental problems such as excessive dissolved solids or excessive chlorine levels.

The use, advantages and benefits of the present invention comprising carboxylate salt compositions and their use in dyeing textile materials, will now be described in more detail by reference to the following specific, non-limiting Examples 1–8.

Since this invention deals with a textile dyeing process, most of the examples will include an "ACS Yield" reading. This number is determined using an Applied Color System Color Eye Spectrophotometer from Applied Color Systems, Inc., Princeton, N.J., which measures depth of shade on the dyed textile material. Depth of shade is related to the amount of dye affixed to the fiber, with a higher ACS yield reflecting more dye bonded to the textile material.

Many of the examples refer to an F1942C formulation of potassium acetate. This formulation is a 57% potassium acetate solution, made up of 35.3% glacial acetic acid and 64.7% of a 50% aqueous solution of potassium hydroxide.

EXAMPLE 1

Example 1 is a demonstration that solutions of salts of readily available carboxylic acids, acetic acid and formic acid, can produce results equivalent to a conventional salt such as sodium chloride in a reactive dyebath. Example 1 is also a demonstration that the preferable metal cation for both acetate and formate salts is potassium. The bottom row of Example 1, Table 1 records the ACS Color Eye dye yields from the different dyebaths.

All dyeings in Example 1 followed the following procedure:

Fabric: 100% bleached cotton knit
Equipment: Ahiba dyeing equipment
Liquor/fabric ratio: 10:1
Procedure:

1. Set dyebath temperature at 100° F. with fabric, water, dyes and salt;

2. Raise the temperature to 180° F. and run the dyebath for 15 minutes;
3. Add soda ash and run the dyebath for 5 minutes;
4. Add sodium hydroxide (50% solution) and run the dyebath for 45 minutes;
5. Rinse, soap off, and rinse.

TABLE 1

Example 1.

| DYEBATHS: | A | B | C | D | E |
|---|---|---|---|---|---|
| Procion Navy HE-XL (Dye) | 3% owf* | 3% owf* | 3% owf* | 3% owf* | 3% owf* |
| Sodium Chloride | 90 g/L | — | — | — | — |
| NaOH (50%) | — | — | 41.9 | | 41.9 |
| KOH (45%) | — | — | — | 65.2 | — |
| Acetic Acid (Glacial) | — | — | 31.7 | — | — |
| Formic Acid (90%) | — | — | — | 26.8 | 26.8 |
| F1942C (57% Potassium Acetate) | — | 90 g/L | — | — | — |
| Soda ash | 8 | 8 | 8 | 8 | 8 |
| NaOH (50%) | 2 | 2 | 2 | 2 | 2 |
| moles acetate | — | 0.581 | 0.581 | — | — |
| moles formate | — | — | — | 0.581 | 0.581 |
| YIELD (ACS) | 109 | 100 | 86 | 91 | 83 |

*owf = on the weight of the fabric

EXAMPLE 2

Example 2 is a comparison, on an equal mass basis, of the sodium and potassium salts of six carboxylic acids that are desirable in terms both availability and cost. Salts of each of the six carboxylic acids produced results equivalent to those obtained with sodium sulfate, which was included to represent the conventional reactive dyebath salts. Potassium nitrate was also included for comparison.

The far left column of Example 2, Table 1 records the various salts used. With the exception of sodium sulfate and potassium nitrate, the salts were generated in situ by the separate, but simultaneous, additions of solutions of the various alkalis and acids directly to the dyebath.

Each of these tests delivered 100 g/L of the test salt to its dyebath. The center column indicates the ratio of the number of ions delivered of the test salt to the number of ions that would have been delivered by an equal mass of sodium sulfate.

The right column records the ACS Color Eye dye yield. As in Example 1, the results demonstrate that carboxylic acid salts mimic the effect of sodium sulfate in reactive dyebaths and that an improvement in yield is observed when potassium rather than sodium is used.

All dyeings in Example 2 followed the following procedure:

Fabric: 100% Bleached Cotton Knit
Liquor/fabric ratio: 20:1
Dye: 3% (owf) Procion Green HE-4BD (C.I. Reactive Green 19)
Procedure:

1. Set dyebath at 100° F. with water and fabric;
2. Add the dye and run the dyebath for 5 minutes;
3. Add the salt component and run the dyebath for 10 minutes;
4. Raise the temperature to 175° F. and run the dyebath for 15 minutes;
5. Add 5 g/L of Alkaflo LSA (a liquid potassium carbonate formulation; Sybron Chemicals Inc., Birmingham, N.J.) to the dyebath;
6. Run the dyebath at 175° F. for 45 minutes, and then drain the dyebath;
7. Rinse cold; rinse hot; soap off; rinse; and dry.

TABLE 1

Example 2,
Liquid Salts of Sodium and Potassium on Equal Solid Basis vs. $Na_2SO_4$ ACS (Yield) Comparison

| SALTS | (Ratio) Ions delivered by test Salt - to No. of ions delivered by equal mass of Sodium Sulfate | YIELD (ACS) |
|---|---|---|
| Sodium Sulfate 90 g/L | 1:1 | 100 - Standard |
| Sodium Acetate | 1.15:1 | 95 |
| Potassium Acetate | 0.96:1 | 108 |
| Sodium Citrate | 0.73:1 | 94 |
| Potassium Citrate | 0.62:1 | 99 |
| Sodium Formate | 1.39:1 | 107 |
| Potassium Formate | 1.12:1 | 113 |
| Sodium Maleate | 0.89:1 | 70 |
| Potassium Maleate | 0.74:1 | 86 |
| Sodium Nitrate | 1.12:1 | 98 |
| Potassium Nitrate | 0.94:1 | 99 |
| Sodium Propionate | 0.98:1 | 99 |
| Potassium Propionate | 0.84:1 | 110 |
| Sodium Tartarate | 1.33:1 | 101 |
| Potassium Tartarate | 1.03:1 | 106 |

EXAMPLE 3

This example is a comparison of the dye yields produced by potassium salts of the carboxylic acids evaluated in Example 2, except that dye yields were determined on an equal mole basis rather than an equal mass basis. The far left column of Example 3, Table 1 indicates the salts used in the individual tests. The middle column is a confirmation that all of the salts delivered 100% of the number of ions of sodium sulfate delivered to the control dyebath.

The far right column records the ACS Color Eye dye yields of the resulting dyed fabrics. Potassium citrate gave the highest yield and surpassed the yield of the control sodium sulfate. Potassium acetate was a close second and also surpassed the yield of the control sodium sulfate. Potassium acetate is the salt of choice because it is the more economical of the top candidates.

All dyeings in Example 3 followed the following procedure:

Fabric: 100% Bleached Cotton Knit
Liquor/fabric ratio: 20:1
Dye: 3% (owf) Procion Green HE-4BD (C.I. Reactive Green 19)
Salt: 90 g/L $Na_2SO_4$ (or equal activity w/salt-substitute)
Procedure:

1. Set the dyebath at 100° F. with water and fabric;
2. Add the dye and run the dyebath for 5 minutes;
3. Add the salt component and run the dyebath for 10 minutes;
4. Raise the temperature to 175° F. and run the dyebath for 15 minutes;
5. Add 5 g/L Alkaflo LSA to the dyebath and run the dyebath at 175° F. for 45 minutes;
6. Drain the dyebath and then rinse the fabric with cold water, hot water, soap off, rinse with warm water and then dry the fabric.

TABLE 1

Example 3,
Liquid Salts of Potassium vs. $Na_2SO_4$ (equal ION-basis)
ACS (Yield) Comparison

| SALTS | % IONS | YIELD (ACS) |
|---|---|---|
| Sodium Sulfate | 100 | 100 - Standard |
| Potassium Acetate | 100 | 109 |
| Potassium Citrate | 100 | 112 |
| Potassium Formate | 100 | 104 |
| Potassium Maleate | 100 | 83 |
| Potassium Nitrate | 100 | 97 |
| Potassium Propionate | 100 | 105 |
| Potassium Tartarate | 100 | 99 |

EXAMPLE 4

Example 4 is a demonstration that a potassium acetate stock solution, referred to as F1942C, will produce results equivalent to those obtained with sodium chloride under standard production procedures, using both reactive dyes and direct dyes. Tables 1–4 show ACS yield comparisons, using representative dyes from the four major groups of reactive dyes, with a pound for pound substitution of the F1942C salt solution for the standard amounts of sodium chloride. Because the F 1942C stock solution is a 57% potassium acetate solution, a pound for pound substitution of sodium chloride only brings 57% of the mass of the standard sodium chloride salt to the dyeing reaction. A pound for pound substitution of F1942C for NaCl results in potassium acetate molar concentration in the dyebath that is 47% that of sodium chloride.

As demonstrated in Tables 1–4, the dye yields with the F 1942C are higher than the dye yields with sodium chloride for many of the dyes. However, in the majority of the cases, the dye yield with the F1942C is slightly lower than the yield with sodium chloride when the standard dye procedures were used. Each table also shows the effect of an "alternate procedure" which is one in which the dyeing process uses Sybron Chemicals Inc.'s Alkaflo Excel as the source of the alkali, instead of the soda ash. These dyeings show an improvement in yield in the majority of cases.

Table 5 of Example 4 demonstrates the utility of the F1942C salt solution in dyeing with direct dyes. The yields indicate that the use of F 1942C as a salt substitute for mineral salts is as effective in the dyeing process for direct dyes as it is in the dyeing process for reactive dyes.

All dyeings in Example 4, Table 1 essentially followed the manufacture's recommended dyeing procedure for Remazol Dyes as described below:

Fabric: 100% Bleached Cotton Knit
Liquor/fabric ratio: 10:1
Procedure:

1. Set the dyebath at 80° F. with water and fabric;
2. Add the dyes and 1.5 g/L of Calgon (40%) to the dyebath, and run the dyebath for 5 minutes;
3. Add the salt components and run the dyebath for 15 minutes;
4. Add 5 g/L of Soda Ash and run the dyebath for 10 minutes;
5. Add 2 g/L of a 50% solution of NaOH and run the dyebath for 5 minutes;
6. Raise the temperature to 140° F. and run the dyebath for 45 minutes. 7. Drain the dyebath and then rinse the fabric with cold water, hot water, soap off, warm rinse, and then dry the fabric.

Alternate Dyeing Procedure: The Alternate dyeing procedure is the same as the manufacturer's recommended procedure, as described above, with the exception that the 5 g/L of Soda Ash is replaced with 2 g/L–3 g/L of Alkaflo EXCEL (a liquid potassium carbonate formulation; Sybron Chemicals Inc., Birmingham, N.J.).

TABLE 1

Example 4,
Remazol - Reactive Dyes W/Liquid Salt-Substitute (F1942C) vs.
NaCl ACS (Yield) Comparison

| | % | Grams | | % Yield per Procedure | | |
|---|---|---|---|---|---|---|
| | Dye | per Liter | | | Standard | Alternate |
| Remazol Dyes | o.w.f. | NaCl | F1942C | NaCl | F1942C | F1942C |
| Remazol Yellow 4GL 150% | 3 | 100 | — | 100 | — | — |
| Remazol Yellow 4GL 150% | 3 | — | 100 | — | 110 | 112 |
| Remazol Yellow 3GL 150% | 3 | 100 | — | 100 | — | — |
| Remazol Yellow 3GL 150% | 3 | — | 100 | — | 106 | 113 |
| Remazol Yellow GR 110% | 3 | 100 | — | 100 | — | — |
| Remazol Yellow GR 110% | 3 | — | 100 | — | 80 | 80 |
| Remazol Orange 3R 135% | 3 | 100 | — | 100 | — | — |
| Remazol Orange 3R 135% | 3 | — | 100 | — | 97 | 97 |
| Remazol Red RB | 3 | 100 | — | 100 | — | — |
| Remazol Red RB | 3 | — | 100 | — | 87 | 90 |
| Remazol Red 3BS | 3 | 100 | — | 100 | — | — |
| Remazol Red 3BS | 3 | — | 100 | — | 99 | 100 |
| *Remazol Blue RW | 3 | 50 | — | 100 | — | — |
| *Remazol Blue RW | 3 | — | 50 | — | 95 | 100 |
| Remazol Blue BB 133% | 3 | 100 | — | 100 | — | — |
| Remazol Blue BB 133% | 3 | — | 100 | — | 92 | 94 |
| Remazol Navy Blue R-GB | 3 | 100 | — | 100 | — | — |
| Remazol Navy Blue R-GB | 3 | — | 100 | | 96 | 100 |
| Remazol Black B | 3 | 100 | — | 100 | — | — |
| Remazol Black B | 3 | — | 100 | — | 94 | 96 |
| Remazol Black RKM | 3 | 100 | — | 100 | — | — |
| Remazol Black RKM | 3 | — | 100 | — | 98 | 102 |

*Slight sensitivity to Potassium

All dyeings in Example 4, Table 2 essentially followed the manufacturer's recommended dyeing procedure for Levafix E and EA Dyes as described below:

Fabric: 100% Bleached Cotton Knit
Liquor/fabric ratio: 10:1
Procedure:

1. Set the dyebath at 100° F. with water and fabric;
2. Add 1.5 g/L of Calgon (40%) and run the dyebath for 5 minutes;
3. Add the salt component and run dyebath for 15 minutes;
4. Add 2 g/L of Soda Ash (over 10 minutes) and run the dyebath for 20 minutes;
5. Raise the temperature of the dyebath to 120° F.;
6. Add 0.5 g/L of a 50% solution of NaOH (over 10 minutes) and run the dyebath for 45 minutes;

7. Drain the dyebath and then rinse the fabric with cold water, hot water, soap off, warm rinse, and then dry the fabric.

Alternate Dyeing Procedure: The alternative dyeing procedure is the same as the manufacturer's recommended procedure with the exception that the 2 g/L of Soda Ash is replaced with 2 g/L–3 g/L Alkaflo EXCEL.

*Modified dyeing procedure for Levafix Royal Blue E-FR follows:

1. Set the dyebath at 100° F. with water and fabric;
2. Add the dye and 1.5 g/L of Calgon (40%) to the dyebath, and run the dyebath for 5 minutes;
3. Add the salt component and run the dyebath for 15 minutes;
4. Add 1.5 g/L of Alkaflo EXCEL and run the dyebath for 10 minutes;
5. Add 1.5 g/L, of Alkaflo EXCEL and 0.5 g/L of NaOH (50% solution) to the dyebath, and run the dyebath for 10 minutes;
6. Raise the temperature to 140° F. and run the dyebath for 45 minutes;
7. Drain the dyebath and rinse the fabric with cold water, hot water, soap off, warm rinse and then dry the fabric.

TABLE 2

Example 4, Levafix - Reactive Dyes W/Liquid Salt-Substitute (F1942C) vs. NaCl ACS (Yield) Comparison

| Levafix, E & EA Dyes | % Dye o.w.f. | Grams per Liter NaCl | Grams per Liter F1942C | % Yield per Procedure NaCl | % Yield per Procedure Standard F1942C | % Yield per Procedure Alternate F1942C |
|---|---|---|---|---|---|---|
| Levafix Golden Yellow EG 150% | 3 | 75 | — | 100 | — | — |
| Levafix Golden Yellow EG 150% | 3 | — | 75 | — | 84 | 84 |
| Levafix Orange E-3GA | 3 | 75 | — | 100 | — | — |
| Levafix Orange E-3GA | 3 | — | 75 | — | 94 | 99 |
| Levafix Scarlet E-26A | 3 | 75 | — | 100 | — | — |
| Levafix Scarlet E-2GA | 3 | — | 75 | — | 100 | 100 |
| Levafix Red E-RN | 3 | 75 | — | 100 | — | — |
| Levafix Red E-RN | 3 | — | 75 | — | 89 | 94 |
| Levafix Red E-BA | 3 | 75 | — | 100 | — | — |
| Levafix Red E-BA | 3 | — | 75 | — | 96 | 98 |
| Levafix Red E-4BA | 3 | 75 | — | 100 | — | — |
| Levafix Red E-4BA | 3 | — | 75 | — | 84 | 89 |
| Levafix Red E-6BA | 3 | 75 | — | 100 | — | — |
| Levafix Red E-6BA | 3 | — | 75 | — | 92 | 94 |
| *Levafix Royal Blue E-FR | 3 | 75 | — | 100 | — | — |
| *Levafix Royal Blue E-FR | 3 | — | 75 | — | 83 | 109* |
| Levafix Blue E-BRLA | 3 | 75 | — | 100 | — | — |
| Levafix Blue E-BRLA | 3 | — | 75 | | Sensitive to Potassium | |
| Levafix Blue EFFN 150% | 3 | 75 | — | — | — | — |

TABLE 2-continued

Example 4, Levafix - Reactive Dyes W/Liquid Salt-Substitute (F1942C) vs. NaCl ACS (Yield) Comparison

| Levafix, E & EA Dyes | % Dye o.w.f. | Grams per Liter NaCl | Grams per Liter F1942C | % Yield per Procedure NaCl | % Yield per Procedure Standard F1942C | % Yield per Procedure Alternate F1942C |
|---|---|---|---|---|---|---|
| Levafix Blue EFFN 150% | 3 | | 75 | | Sensitive to Potassium | |
| Levafix Navy Blue EBNA | 3 | 75 | — | 100 | — | — |
| Levafix Navy Blue EBNA | 3 | — | 75 | — | 95 | 94 |

*The modified dyeing procedure for Levafix Royal Blue E-FR was used with the F1942C potassium acetate solution in lieu of the alternate dyeing procedure.

All dyeings in Example 4, Table 3 essentially followed the manufacturer's reconmnended dyeing procedure for Procion HE Dyes. The dyeing procedure was as follows:

Fabric: 100% Bleached Cotton Knit

Liquor/fabric ratio: 10:1

1. Set the dyebath at 100° F. with water and fabric;
2. Add the dye and 1.5 g/L Calgon (40%) to the dyebath and run the dyebath for 5 minutes;
3. Add the salt component to the dyebath;
4. Raise the temperature to 180° F. and run the dyebath for 15 minutes;
5. Add 8 g/L soda ash and run the dyebath for 5 minutes;
6. Add 2 g/L of NaOH (50% solution) and run the dyebath for 45 minutes;
7. Drain the dyebath and then rinse the fabric with cold water, hot water, soap off, warm rinse and then dry the fabric.

The alternative dyeing procedure is the same as described above with the exception that the 8 g/L of soda ash is replaced with 3 g/L of Alkaflo EXCEL.

TABLE 3

Example 4, Procion - Reactive Dyes W/Liquid Salt-Substitute (F1942C) vs. NaCl ACS (yield) Comparison

| Procion HE Dyes | % Dye o.w.f. | Grams per Liter NaCl | Grams per Liter F1942C | % Yield per Procedure NaCl | % Yield per Procedure Standard F1942C | % Yield per Procedure Alternate F1942C |
|---|---|---|---|---|---|---|
| Procion Yellow HEXL | 3 | 90 | — | 100 | — | — |
| Procion Yellow HEXL | 3 | — | 90 | — | 89 | 86 |
| Procion Yellow HE4R | 3 | 90 | — | 100 | — | — |
| Procion Yellow HE4R | 3 | — | 90 | — | 90 | 87 |
| Procion Orange HEXL | 3 | 90 | — | 100 | — | — |
| Procion Orange HEXL | 3 | — | 90 | — | 93 | 93 |
| Procion Orange HER | 3 | 90 | — | 100 | — | — |
| Procion Orange HER | 3 | — | 90 | — | 93 | 98 |
| Procion Red HEGA | 3 | 90 | — | 100 | — | — |

TABLE 3-continued

Example 4,
Procion - Reactive Dyes W/Liquid Salt-Substitute (F1942C) vs. NaCl ACS (yield) Comparison

| | % | Grams | | % Yield per Procedure | | |
|---|---|---|---|---|---|---|
| | Dye | per Liter | | | Standard | Alternate |
| Procion HE Dyes | o.w.f. | NaCl | F1942C | NaCl | F1942C | F1942C |
| Procion Red HEGA | 3 | — | 90 | — | 89 | 101 |
| Procion Crimson HEXL | 3 | 90 | — | 100 | — | — |
| Procion Crimson HEXL | 3 | — | 90 | — | 90 | 104 |
| Procion Blue HERD | 3 | 90 | — | 100 | — | — |
| Procion Blue HERD | 3 | — | 90 | — | 92 | 96 |
| Procion Blue HEXL | 3 | 90 | — | 100 | — | — |
| Procion Blue HEXL | 3 | — | 90 | — | 88 | 90 |
| Procion Navy HEXL | 3 | 90 | — | 100 | — | — |
| Procion Navy HEXL | 3 | — | 90 | | 88 | 92 |
| Procion Red Brown HEXL | 3 | 90 | — | 100 | — | — |
| Procion Red Brown HEXL | 3 | — | 90 | — | 85 | 82 |

All dyeings in Example 4, Table 4a essentially followed the manufacturer's recommended dyeing procedure for Cibacron F and Cibacron C dyes. The procedure followed is described below:

Liquor/fabric ratio: 10:1

Fabric: 100% Bleached Cotton Knit

Procedure: Cibacron F

1. Set dyebath at 100° F. with water and fabric;
2. Add the dye and 1.5 g/L of Calgon (40%) to the dyebath, and run the dyebath for 5 minutes;
3. Add the salt component while raising the temperature to 140° F. and run the dyebath for 30 minutes at 140° F.;
4. Add 6 g/L of Soda Ash (over 10 minutes);
5. Run the dyebath for 45 minutes;
6. Drain the dyebath and rinse the fabric with cold water, hot water, soap off, warm rinse and then dry the fabric.

Procedure: Cibacron C

1. Set dyebath at 100° F. with water and fabric;
2. Add the dye and 1.5 g/L of Calgon (40%) to the dyebath and run the dyebath for 5 minutes;
3. Add the salt component and run the dyebath for 15 minutes;
4. Add 14 g/L Soda Ash (in 2 halves over 20 minutes);
5. Raise the temperature to 140° F. and run the dyebath for 45 minutes;
6. Drain the dyebath and rinse the fabric with cold water, hot water, soap off, warm rinse, and then dry the fabric.

Alternate Procedure: Cibacron F:

1. Set dyebath at 100° F. with water and fabric;
2. Add the dye and 1.5 g/L of Calgon (40%) to the dyebath and run the dyebath for 5 minutes;
3. Add the salt component while raising the temperature to 140° F. and run the dyebath for 30 minutes;
4. Add 4 g/L Alkaflo EXCEL and run the dyebath for 5 minutes;
5. Add 0.5 g/L NaOH (50% solution) and run the dyebath for 45 minutes;
6. Rinse the fabric with cold water, hot water, soap off, warm rinse, and then dry the fabric.

Alternate Procedure: Cibacron C:

1. Set dyebath at 100° F. with water and fabric;
2. Add the dye and 1.5 g/L Calgon (40%) and run the dyebath for 5 minutes;
3. Add 3 g/L–4 g/L Alkaflo EXCEL and run the dyebath for 5 minutes;
4. Raise the temperature to 120° F. and run the dyebath for 5 minutes;
5. Add 1 g/L NaOH (50% solution) and run the dyebath for 45 minutes;
6. Drain the dyebath and rinse the fabric with cold water, hot water, soap off, warm rinse, and then dry the fabric.

TABLE 4a

Example 4,
Cibacron F, and Cibacron C - Reactive Dyes W/Liquid Salt - Substitute (F1942C) vs. NaCl ACS (Yield) Comparison

| Cibacron F; | % | Grams | | % Yield per Procedure | | |
|---|---|---|---|---|---|---|
| Cibacron | Dye | per Liter | | | Standard | Alternate |
| C - Dyes | o.w.f. | NaCl | F1942C | NaCl | F1942C | F1942C |
| Cibacron Yellow F4G | 3 | 60 | — | 100 | — | — |
| Cibacron Yellow F-4G | 3 | — | 60 | — | 90 | 87 |
| Cibacron Yellow F3R | 3 | 60 | — | 100 | — | — |
| Cibacron Yellow F3R | 3 | — | 60 | — | 90 | 86 |
| Cibacron Yellow CR-01 | 3 | 70 | — | 100 | — | — |
| Cibacron Yellow CR-01 | 3 | — | 70 | — | 94 | 92 |
| Cibacron Navy C-B | 3 | 70 | — | 100 | — | — |
| Cibacron Navy C-B | 3 | — | 70 | — | 93 | 93 |

All dyeings in Example 4, Table 4b essentially followed the manufacture's recommended dyeing procedure for Intacron Dyes. The dyeing procedure was as follows:

Fabric: 100% Bleached Cotton Knit

Liquor/fabric ratio: 10:1

Procedure:

1. Set the dyebath at 80° F. with water and fabric;
2. Add the dye and 1.5 g/L Calgon (40%) to the dyebath, and run the dyebath for 5 minutes;
3. Add the salt component and run the dyebath for 15 minutes;
4. Add 5 g/L of Soda Ash and run the dyebath for 10 minutes;
5. Add 2 g/L of NaOH (50% solution) and run the dyebath for 5 minutes;
6. Raise the temperature to 140° F. and run the dyebath for 45 minutes;
7. Drain the dyebath, and rinse the fabric with cold water, hot water, soap off, warm rinse, and then dry the fabric.

Alternate Dyeing Procedure: The alternate dyeing procedure is the same as described above with the exception that the 5 g/L of Soda Ash is replaced with 3 g/L Alkaflo EXCEL and 2 g/L of a 50% NaOH solution is replaced with 1.0 g/L of a 50% solution of NaOH.

TABLE 4b

Example 4, Intacron - Reactive Dyes W/Liquid Salt-Substitute (F1942C) vs. NaCl ACS (Yield) Comparison

| Intacron VS - Dyes | % Dye o.w.f. | Grams per Liter NaCl | Grams per Liter F1942C | % Yield per Procedure Standard NaCl | % Yield per Procedure Standard F1942C | % Yield per Procedure Alternate F1942C |
|---|---|---|---|---|---|---|
| Intacron Orange VS 3G 150% | 3 | 65 | | 100 | — | — |
| Intacron Orange VS 3G 150% | 3 | — | 65 | — | 92 | 98 |

All dyeings in Example 4, Table 4c essentially followed the manufacturer's recommended dyeing procedure for Rite Reactive Dyes. The dyeing procedure was as follows:
Fabric: 100% Bleached Cotton Knit
Liquor/fabric Ratio: 10:1
Procedure:

1. Set the dyebath at 100° F. with water and fabric;
2. Add dye and 1.5 g/L Calgon (40%) to the dyebath, and run the dyebath for 5 minutes;
3. Add the salt component and run the dyebath for 15 minutes;
4. Add 5 g/L of Soda Ash and run the dyebath for 10 minutes;
5. Add 2 g/L of NaOH (50% solution) and run the dyebath for 5 minutes;
6. Raise the temperature to 160° F. and run the dyebath for 45 minutes;
7. Drain the dyebath, and then rinse the fabric with cold water, hot water, soap off, warm rinse, and then dry the fabric.

Alternate Dyeing Procedure: The alternate dyeing procedure was the same as described above with the exception that the 5 g/L of soda ash was replaced with 2 g/L to 3 g/L of Alkaflo EXCEL.

TABLE 4c

Example 4, Rite - Reactive Dyes W/Liquid Salt-Substitute (F1942C) vs. NaCl ACS (Yield) Comparison

| Rite - Reactive - Dye | % Dye o.w.f. | Grams per Liter NaCl | Grams per Liter F1942C | % Yield per Procedure Standard NaCl | % Yield per Procedure Standard F1942C | % Yield per Procedure Alternate F1942C |
|---|---|---|---|---|---|---|
| Rite Reactive Turq. GAK | 3 | 100 | | 100 | — | — |
| Rite Reactive Turq. GAK | 3 | — | 100 | — | 102 | 103 |

The direct dyeing procedure for the dye tests shown in Example 4, Table 5 is described below:
Fabric: 100% Bleached Cotton Knit
Liquor/fabric ratio: 20:1
Dye: X% (owf) (see table)
Salt: X% (owf) (see table)
Procedure:

1. Set dyebath at 100° F.–120° F. with water and fabric;
2. Add the dye and run the dyebath for 10 minutes;
3. Add the salt components while raising the temperature to 212° F., and run the dyebath at 212° F. for 45 minutes;
4. Cool the dyebath to 160° F.;
5. Drain the dyebath, rinse the fabric with cold water and then dry the fabric.

TABLE 5

Example 4, Direct-Dyes W/Liquid Salt Substitute (F1942C) vs. NaCl ACS (Yield) Comparison

| Direct Dyes | % Dye | % NaCl | % F1942C | Yield (ACS) |
|---|---|---|---|---|
| Superlite Fst Yellow EFC (C.I. Dir. Yellow 106) | 2 | 40 | — | 100 |
| Superlite Fst Yellow EFC (C.I. Dir. Yellow 106) | 2 | — | 40 | 98 |
| Direct Fst Scarlet 4BS 150% (C.I. Dir. Red 23) | 1 | 20 | — | 100 |
| Direct Fst Scarlet 4BS 150% (C.I. Dir. Red 23) | 1 | — | 20 | 99 |
| Superlite Fst Blue 8GLN (C.I. Dir. Blue 191) | 2 | 40 | — | 100 |
| Superlite Fst Blue 8GLN (C.I. Dir. Blue 191) | 2 | — | 40 | 103 |
| Intralite Turq. Blue GRLL (C.I. Dir. Blue 189) | 2 | 40 | — | 100 |
| Intralite Turq. Blue GRLL (C.I. Dir. Blue 189) | 2 | — | 40 | 90 |
| Fabramine Black B 150% (C.I. Dir. Black 80) | 4 | 40 | — | 100 |
| Fabramine Black B 150% (C.I. Dir. Black 80) | 4 | — | 40 | 100 |

EXAMPLE 5

Example 5 is a description of how certain dyes which are sensitive to the presence of the potassium cations in the dye solution can be utilized in accordance with this invention. Referring back to Example 4, Table 2, it should be noted that the dyes Levafix Blue E-BRLA and Levafix Blue EFFN 150% are sensitive to the presence of the potassium cation in solution. Also, from Example 4, Table 1, it should be noted that Remazol Blue RW is also somewhat sensitive to potassium.

In these dyeings, the dyes do not change colors in solution and they tend to exhaust onto the fabrics unusually well. However, they wash off almost totally in the washing step. It has been found that this phenomenon is correctable by using a blend of sodium and potassium acetates delivered by the same solution instead of the F1942C potassium acetate formulation. Another approach is to use the F1942C potassium acetate formulation as it is and to then use pure soda ash as the alkali source. Either of these approaches can be used separately to overcome the problem of potassium sensitive dyes and they can also be used in combination.

EXAMPLE 6

Example 6 is a demonstration that, in conjunction with the use of potassium acetate as the salt in the dyebath, the addition of small amounts of potassium sulfate to the dyebath results in an improvement in dye yield. As shown in Example 6, Table 1, the indications are that the yield is greater with lesser amounts of $K_2SO_4$, reaching an optimum, in this example, at about 1 g/L.

The dyeing procedure for the dye tests shown in Example 6, Table 1 is as follows:
Fabric: 100% bleached cotton knit
Liquor/fabric ratio: 10:1
Dye: 3% owf Procion NAVY HEXL
Equipment: Ahiba lab dyeing equipment Procedure:

1. Set the dyebath at 100° F. with water, dye, and fabric and run the dyebath for 5 minutes;
2. Add the salt component to the dyebath;
3. Raise the temperature to 180° F. and run the dyebath for 15 minutes;
4. Add 8 g/L of soda ash and run the dyebath for 5 minutes;
5. Add 2 gI/L of sodium hydroxide (50% solution) and run the dyebath for 45 minutes;
6. Drain the dyebath and then rinse the fabric with cold water, soap off, cold rinse, and then dry the fabric.

TABLE 1

Example 6.

| | g/L SALT | | | |
|---|---|---|---|---|
| SALT | TEST 1 | TEST 2 | TEST 3 | TEST 4 |
| F1942C | 90.0 | 70.0 | 88.0 | 89.0 |
| $K_2SO_4$ | — | 26.0 | 2.0 | 1.0 |
| YIELD | 100 | 99 | 101 | 103 |

EXAMPLE 7

Example 7 is a demonstration of the environmental benefits associated with the use of potassium acetate as a replacement for the conventional salts of sodium chloride and sodium sulfate in the dyeing process. Table 1 of Example 7 illustrates that the use of the F1942C potassium acetate formulation as a pound for pound replacement for either sodium chloride or sodium sulfate as the salt in the dyeing process delivers less dissolved solids to the effluent system. Table 2 of Example 7 illustrates that potassium acetate is biodegradable whereas the conventional salts are not.

TABLE 1

Example 7,
Dissolved Solids Delivered By Salts

| SALT | % SOLIDS | GRAMS/LITER SALT IN DYE SOLUTION | DISSOLVED |
|---|---|---|---|
| NaCl | 100% | 100 g/L | 100 g/L |
| $Na_2SO_4$ | 100% | 100 g/L | 100 g/L |
| F1942C | 57% | 57 g/L | 57 g/L |

TABLE 2

Example 7,
Comparison of the Biodegradability of Salts

| SALT | BOD (5)[1] | COD[2] | BIODEGRADABILITY |
|---|---|---|---|
| NaCl | 0 ppm | 0 ppm | not biodegradable |
| $Na_2SO_4$ | 0 ppm | 0 ppm | not biodegradable |
| F1942C | 137,560 ppm | 349,800 ppm | 68% biodegradable in 5 days |

[1]The Biochemical Oxygen Demand (BOD) test was conducted according to the SM 5210A and SM 5210B methods described in Water/Wastewater Standard Methods Manual, 18th Edition.
[2]The Chemical Oxygen Demand (COD) test was conducted according to the SM 5220A and SM 5220D methods described in Water/Wastewater Standard Methods Manual, 18th Edition.

EXAMPLE 8

Example 8 is a demonstration that the F1942C potassium acetate formulation is less corrosive to dyeing equipment than are conventional salts. Example 8, Table 1 shows that potassium acetate is virtually not corrosive to 316 stainless steel, which is the metal alloy of choice in the manufacture of textile reactive dyeing equipment. Example 8, Table 2 shows that potassium acetate is less damaging to soft steel than are conventional salts.

TABLE 1

Example 8,
Corrosivity of Various Salts to 316 Stainless Steel (3 inch × 1/2 inch 316 stainless test plates provided commercially, immersed in 10% aqueous solutions of various salts at 120° F. for 72 hours)

| SALT | MICRONS PER YEAR OF METAL LOST |
|---|---|
| $Na_2SO_4$ | 7.0 |
| NaCl | 8.3 |
| F1942C | 0.1 |

TABLE 2

Example 8,
Corrosivity of Various Salts to Soft Steel (3 inch × 1/2 inch soft steel plates provided commercially, immersed in 10% aqueous solutions of various salts under pressure at 265° F. for 88 hours)

| SALT | PERCENT METAL WEIGHT LOSS |
|---|---|
| NaCl | 0.88% |
| $Na_2SO_4$ | 1.01% |
| F1942C | 0.58% |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An immersion method of dyeing textile material comprising the steps of:

(a) providing a textile material comprising at least one of cotton and regenerated cellulosic fibers;

(b) providing an aqueous dyebath in a weight ratio of dyebath:textile material of 10:1 to 20:1, the dyebath comprising a reactive dye and a carboxylate salt for salting out the dye onto the textile material, the carboxylate salt having a carboxylate anionic component and a monovalent cationic component, wherein the carboxylate salt is present in an amount effective for salting out the dye onto the textile material;

(c) immersing the textile material in the aqueous dyebath under conditions sufficient to salt the dye onto the textile material;

(d) adding to the dyebath an alkaline material to promote a reaction to form a chemical bond between the dye and the textile material; and (e) subjecting the dyebath containing the textile material and the alkaline material to conditions sufficient to form a chemical bond between the dye and the textile material.

2. A method of dyeing textile material according to claim 1, wherein the carboxylate salt is present in the aqueous dyebath in an amount of about 0.04 mole/L to about 0.7 mole/L.

3. A method of dyeing textile material according to claim 1, wherein the carboxylate salt is present in the aqueous dyebath in an amount of about 0.058 mole/L to about 0.58 mole/L.

4. A method of dyeing textile material according to claim 1, wherein the carboxylate salt in the aqueous dyebath is potassium acetate present in an amount of about 5.7 g/L to about 68.4 g/L.

5. A method of dyeing textile material according to claim 1, wherein the alkaline material is selected from the group consisting of soda ash, NaOH and liquid potassium carbonate.

6. A method of dyeing textile material according to claim 1, wherein the carboxylate anionic component in the aqueous dyebath is comprised of an anion selected from the group consisting of formate, acetate, propionate, citrate, maleate and tartarate.

7. A method of dyeing textile material according to claim 6, wherein the monovalent cationic component in the aqueous dyebath is selected from the group consisting of lithium, sodium and potassium.

8. A method of dyeing textile material according to claim 1, wherein the carboxylate anionic component is comprised of acetate and the monovalent cationic component is comprised of potassium.

9. A method of dyeing textile material according to claim 1, wherein the textile material is comprised of cotton.

10. A method of dyeing textile material according to claim 1, wherein the carboxylate salt in the aqueous dyebath is potassium acetate present in an amount of about 35 g/L to about 62 g/L.

11. A method of dyeing textile material according to claim 10, wherein the aqueous dyebath further comprises $K_2SO_4$ present in amount of about 0.5 g/L to about 2.0 g/L.

12. An immersion method of dyeing textile material comprising the steps of:

(a) providing a textile material comprising at least one of cotton and regenerated cellulosic fibers;

(b) providing an aqueous dyebath in a weight ratio of dyebath:textile material of 10:1 to 20:1, the dyebath comprising a reactive dye and a salt for salting out the dye onto the textile material, the salt having a carboxylate anionic component and a monovalent cationic component, wherein the salt is present in an amount effective for salting out the dye onto the textile material, and wherein the anionic component is comprised of at least about 30% of at least one carboxylate anion, on a molar basis, and the cationic component is comprised of at least about 30% of at least one monovalent cation, on a molar basis;

(c) immersing the textile material in the aqueous dyebath under conditions sufficient to salt the dye onto the textile material;

(d) adding to the dyebath an alkaline material to promote a reaction to form a chemical bond between the dye and the textile material; and (e) subjecting the dyebath containing the textile material and the alkaline material to conditions sufficient to form a chemical bond between the dye and the textile material.

13. A method of dyeing textile material according to claim 12, wherein the carboxylate anionic component in the aqueous dyebath is comprised of an anion selected from the group consisting of formate, acetate, propionate, citrate, maleate and tartarate.

14. A method of dyeing textile material according to claim 13, wherein the monovalent cationic component in the aqueous dyebath is selected from the group consisting of lithium, sodium and potassium.

15. A method of dyeing textile material according to claim 12, wherein the carboxylate anionic component is comprised of acetate and the monovalent cationic component is comprised of potassium.

16. A method of dyeing textile material according to claim 12, wherein the textile material is comprised of cotton.

17. A method of dyeing textile material according to claim 12, wherein the salt is present in the aqueous dyebath in an amount of about 0.04 mole/L to about 0.7 mole/L.

18. A method of dyeing textile material according to claim 12, wherein the salt is present in the aqueous dyebath in an amount of about 0.058 mole/L to about 0.58 mole/L.

19. A method of dyeing textile material according to claim 12, wherein the salt in the aqueous dyebath is potassium acetate present in an amount of about 5.7 g/L to about 68.4 g/L.

20. A method of dyeing textile material according to claim 12, wherein the salt in the aqueous dyebath is potassium acetate present in an amount of about 35 g/L, to about 62 g/L.

21. A method of dyeing textile material according to claim 20, wherein the aqueous dyebath further comprises $K_2SO_4$ present in amount of about 0.5 g/L to about 2.0 g/L.

22. A method of dyeing textile material according to claim 12, wherein the anionic component of the salt is comprised of at least about 60% of at least one carboxylate anion, on a molar basis, and the cationic component of the salt is comprised of at least about 60% of at least one monovalent cation, on a molar basis.

23. A method of dyeing textile material according to claim 12, wherein the anionic component of the salt is comprised of at least about 85% of at least one carboxylate anion, on a molar basis, and the cationic component of the salt is comprised of at least about 85% of at least one monovalent cation, on a molar basis.

24. A method of dyeing textile material according to claim 12, wherein the dyebath further comprises another salt for salting out the dye onto the textile material selected from the group consisting of NaCl, $Na_2SO_4$, $K_2SO_4$, $NaNO_3$ and $KNO_3$.

25. A method of dyeing textile material according to claim 12, wherein the alkaline material is selected from the group consisting of soda ash, NaOH and liquid potassium carbonate.

* * * * *